US008317353B1

(12) United States Patent
Martin

(10) Patent No.: US 8,317,353 B1
(45) Date of Patent: Nov. 27, 2012

(54) DECORATIVE ROOF LIGHT COVERING SYSTEM

(76) Inventor: Marilyn J. Martin, Apple Valley, CA (US)

( * ) Notice: Subject to any disclaimer, the term of this patent is extended or adjusted under 35 U.S.C. 154(b) by 594 days.

(21) Appl. No.: 12/356,934

(22) Filed: Jan. 21, 2009

(51) Int. Cl.
*F21S 4/00* (2006.01)

(52) U.S. Cl. ..... 362/145; 362/240; 362/374; 52/12; 52/28; 52/94; 248/339; 248/690

(58) Field of Classification Search ..... 362/145, 362/374, 249.16, 565, 152, 151, 653, 249.02, 362/249.06, 249.14, 240, 244, 248, 311.13, 362/806; 52/12, 28, 94; 248/48.1, 48.2, 248/359, 690–692, 237
See application file for complete search history.

(56) References Cited

U.S. PATENT DOCUMENTS 3,204,090 A * 8/1965 Kvarda, Jr. ..... 362/249.01
3,692,993 A 9/1972 Robinson
3,883,926 A * 5/1975 Reynolds ..... 248/74.1
4,600,975 A * 7/1986 Roberts ..... 362/147
5,311,414 A 5/1994 Branham, Sr.
D351,555 S 10/1994 Blott
5,404,279 A * 4/1995 Wood ..... 362/145
5,510,966 A 4/1996 Konecny
5,581,956 A * 12/1996 Fennessy et al. ..... 52/28
5,813,751 A * 9/1998 Shaffer ..... 362/249.08
5,816,687 A * 10/1998 Tapp ..... 362/249.01
5,823,655 A 10/1998 Brooks
6,019,488 A 2/2000 Hastings
6,050,709 A * 4/2000 Hastings ..... 362/375
6,088,967 A * 7/2000 Johnson ..... 52/28
6,224,232 B1 5/2001 Rodriguez
6,309,086 B1 * 10/2001 Tomlinson ..... 362/240
6,363,662 B1 * 4/2002 Coates ..... 52/12
6,474,840 B2 * 11/2002 Padermos ..... 362/145
6,846,092 B2 * 1/2005 Taylor et al. ..... 362/235
6,955,458 B2 * 10/2005 Cheema ..... 362/581
6,997,577 B1 * 2/2006 Pepito et al. ..... 362/238
7,059,749 B1 * 6/2006 Bernier ..... 362/396
7,306,354 B2 * 12/2007 Haas ..... 362/432
7,845,819 B1 * 12/2010 Strong ..... 362/145
2005/0225982 A1 * 10/2005 Hahn ..... 362/252
2010/0110668 A1 * 5/2010 Marlonia ..... 362/152

* cited by examiner

*Primary Examiner* — Diane Lee
*Assistant Examiner* — Mary McManmon

(57) ABSTRACT

A decorative roof light covering system includes a roof overhang that is attached to and extends downwardly from a roof. The roof overhang has a bottom edge, a first side and a second side. A plurality of decorations is attached to the bottom edge of the roof overhang. A cover includes a bottom wall that has a top side, a first lateral edge and a second lateral edge. A first lateral wall is attached to and extends along the first lateral edge. A second lateral wall is attached to and extends along the second lateral edge. Each of the first and second lateral walls extends upwardly from the top side. A coupling assembly is attached to the roof overhang and releasably couples the cover to the roof overhang. The cover is attached to the roof overhang when the decorations are to be hidden from view.

5 Claims, 5 Drawing Sheets

DECORATIVE ROOF LIGHT COVERING SYSTEM

BACKGROUND OF THE DISCLOSURE

Field of the Disclosure

The disclosure relates to decoration covering devices and more particularly pertains to a new decoration covering device for allowing a person to cover from view decorations hanging from roof overhang until the decorations are to be displayed again.

SUMMARY OF THE DISCLOSURE

An embodiment of the disclosure meets the needs presented above by generally comprising a roof overhang that is attached to and extends downwardly from a roof. The roof overhang has a bottom edge, a first side and a second side positioned opposite of the first side. A plurality of decorations is attached to the bottom edge of the roof overhang. A cover includes a bottom wall that has a top side, a bottom side, a first lateral edge, a second lateral edge, a first end edge, and a second end edge. A first lateral wall is attached to and extends along the first lateral edge. A second lateral wall is attached to and extends along the second lateral edge. Each of the first and second lateral walls extends upwardly from the top side. A coupling assembly is attached to the roof overhang and releasably couples the cover to the roof overhang. The cover is attached to the roof overhang when the decorations are to be hidden from view.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
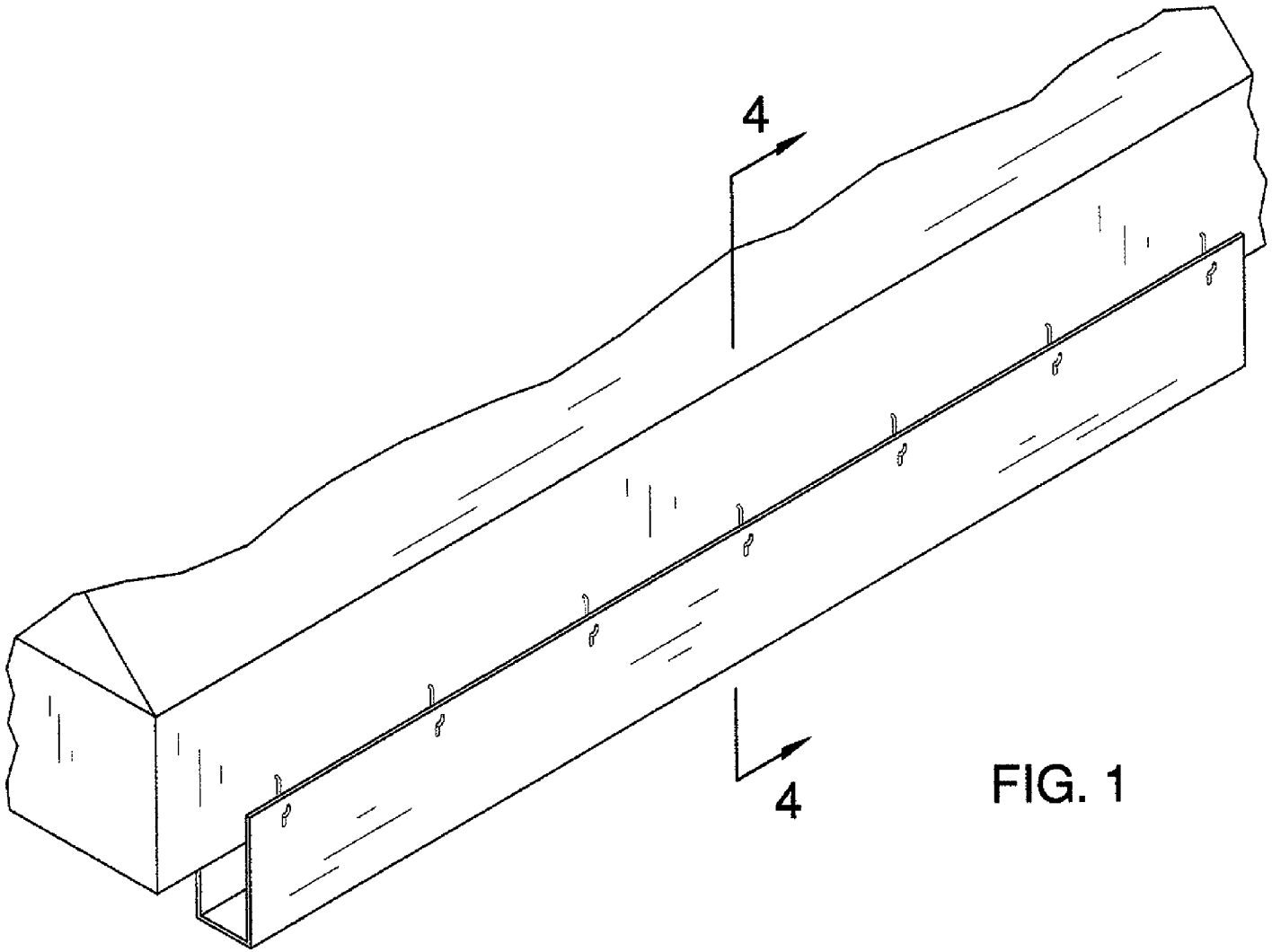
FIG. 1 is a top perspective view of a decorative roof light covering system according to an embodiment of the disclosure.
Figure 2:
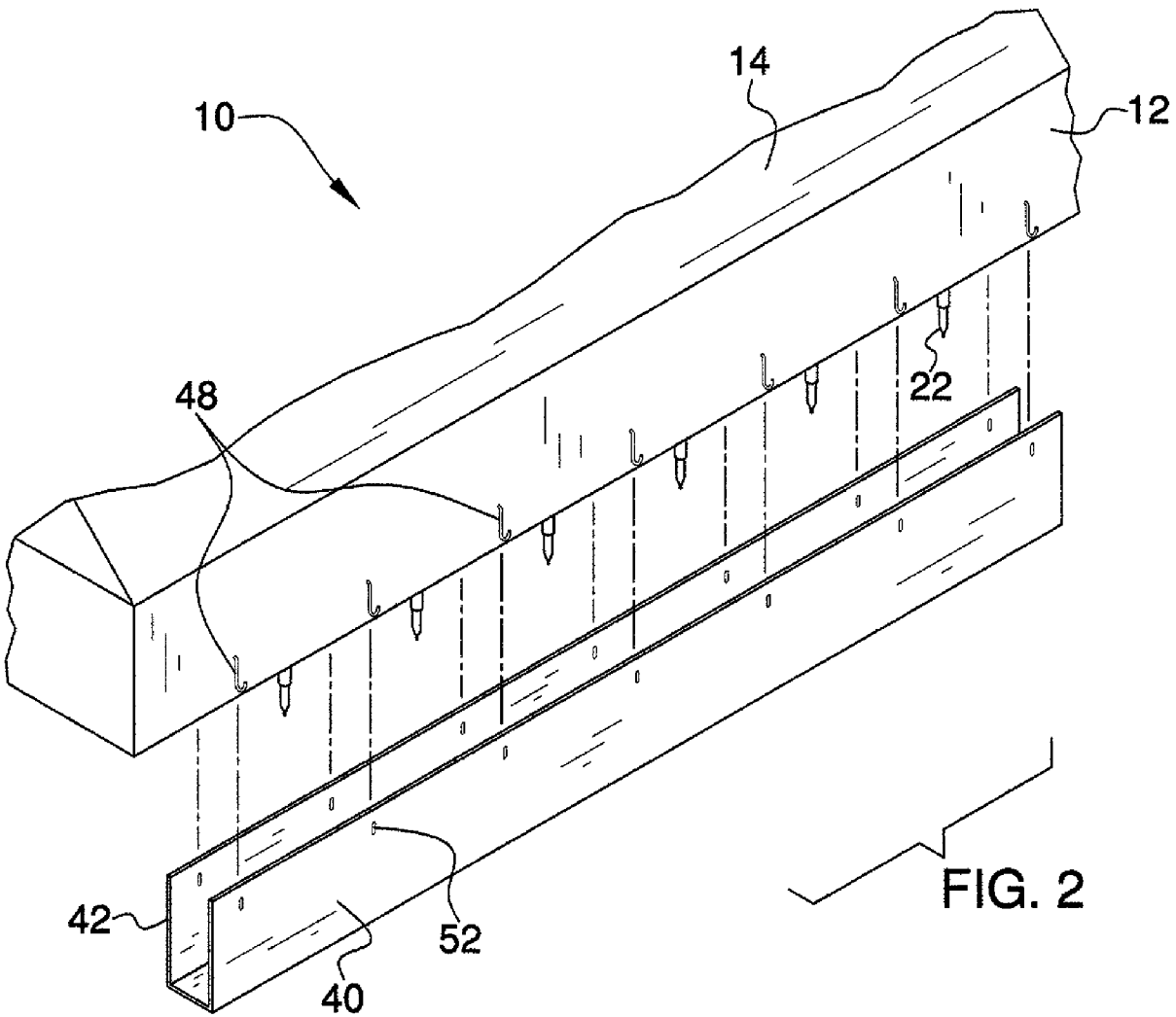
FIG. 2 is an expanded top perspective view of an embodiment of the disclosure.
Figure 3:
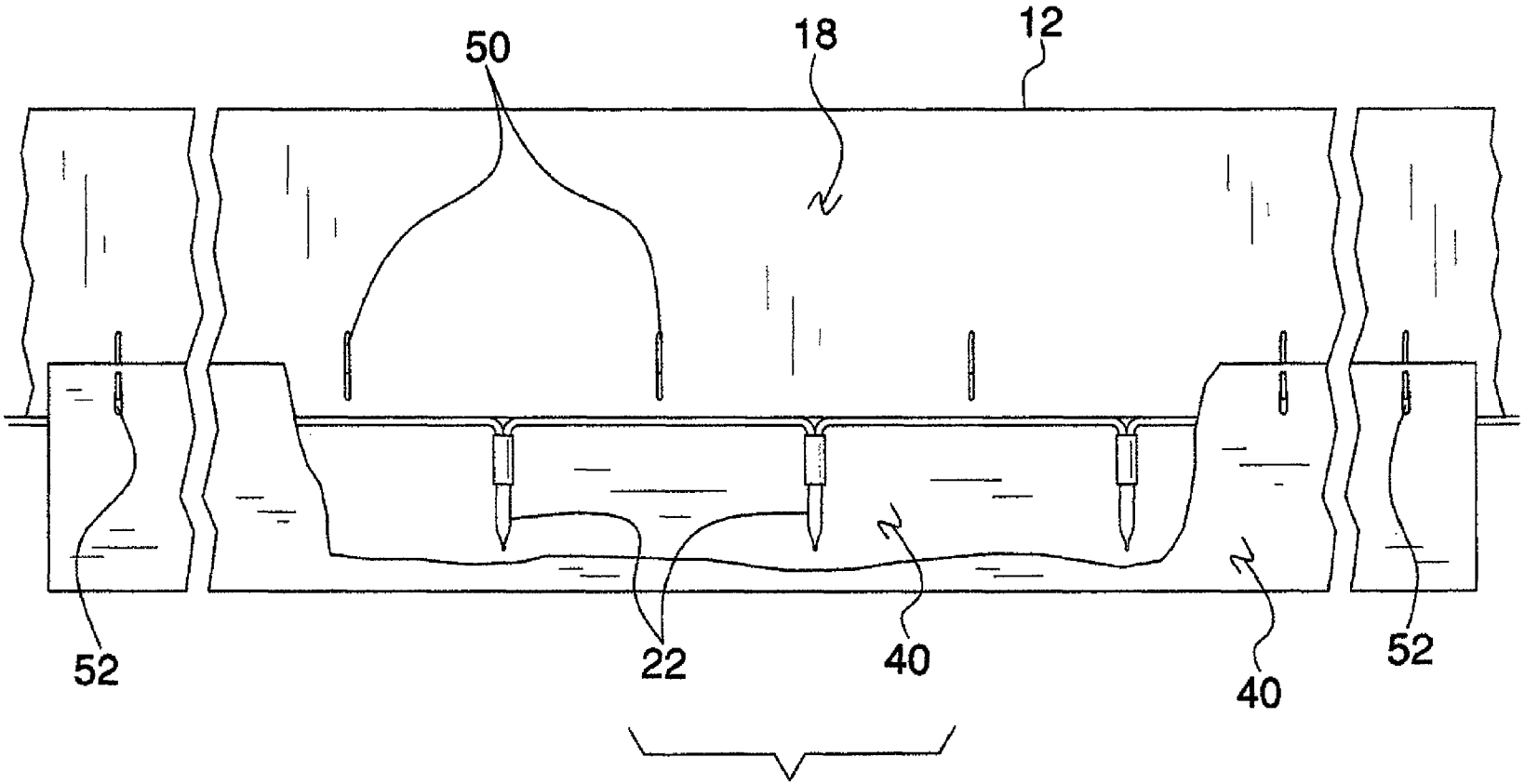
FIG. 3 is a rear broken view of an embodiment of the disclosure.
Figure 4:
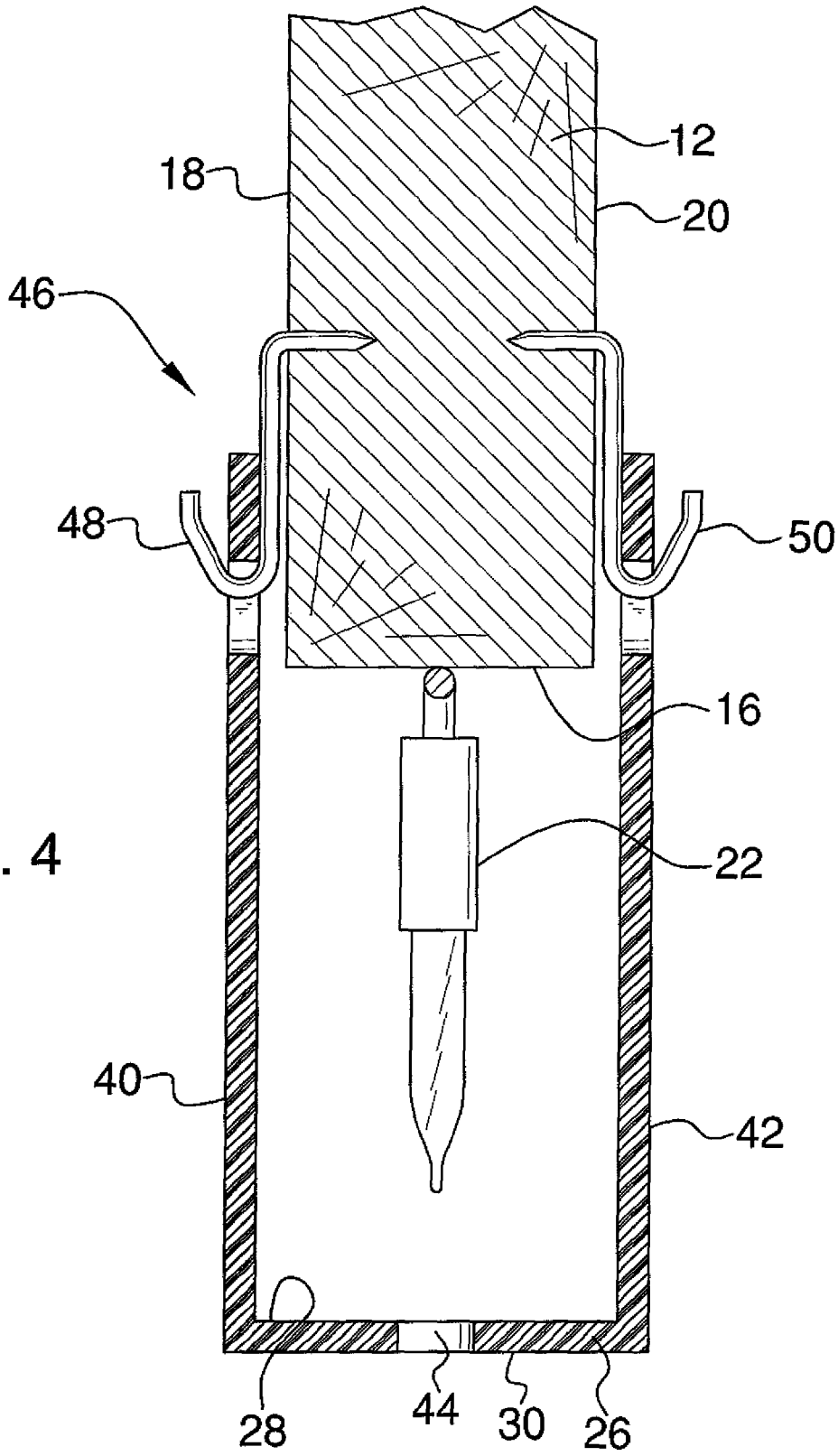
FIG. 4 is a cross-sectional view taken along line 4-4 of FIG. 1 of an embodiment of the disclosure.
Figure 5:
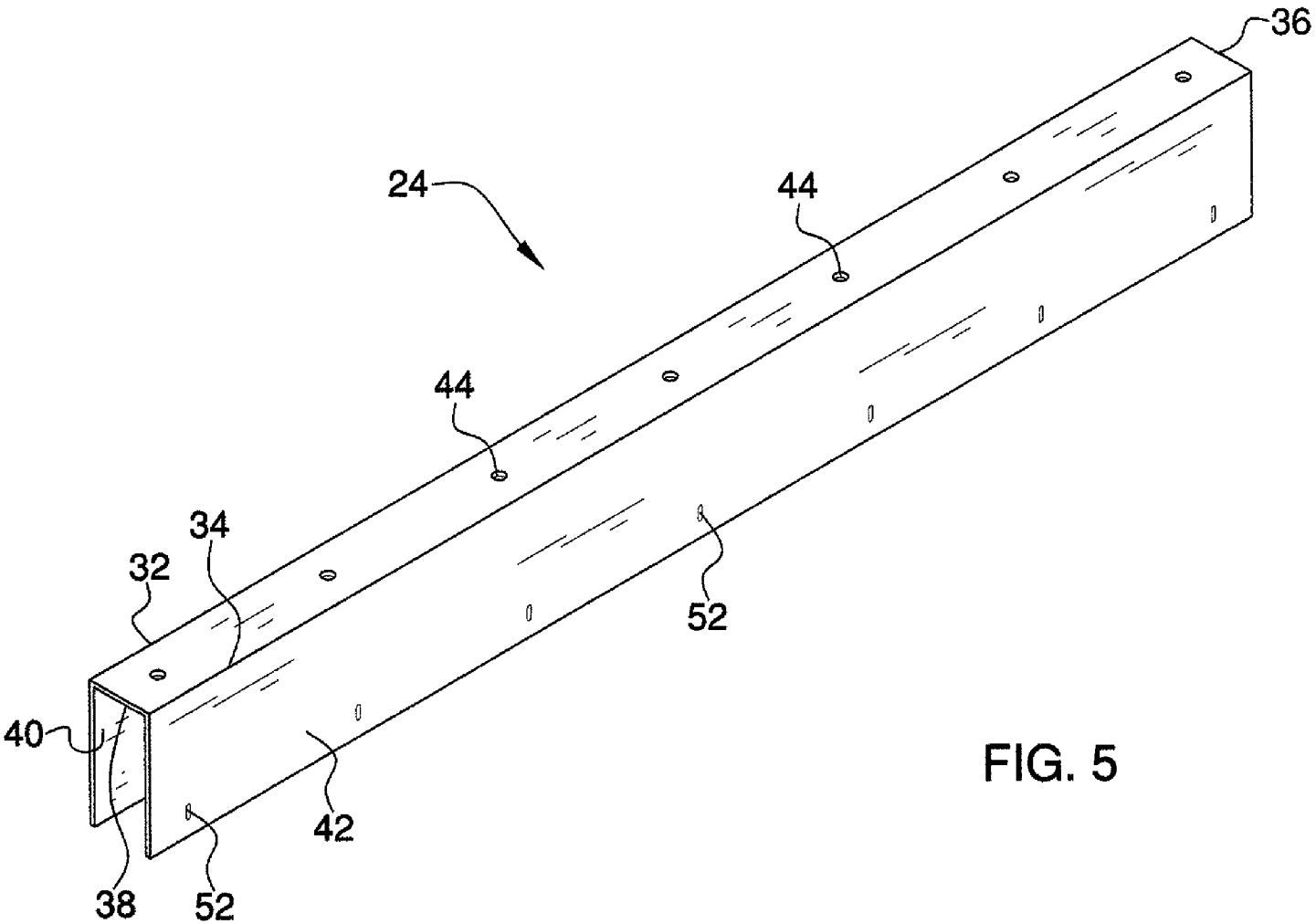
FIG. 5 is a bottom view of a cover of an embodiment of the disclosure.

With reference now to the drawings, and in particular to FIGS. 1 through 5 thereof, a new decoration covering device embodying the principles and concepts of an embodiment of the disclosure and generally designated by the reference numeral 10 will be described.

As best illustrated in FIGS. 1 through 5, the decorative roof light covering system 10 generally comprises a roof overhang 12, or eaves, that is attached to and extends downwardly from a roof 14. The roof overhang 12 has a bottom edge 16, a first side 18 and a second side 20 positioned opposite of the first side 18.

A plurality of decorations 22 is attached to the bottom edge 16 of the roof overhang 12. While the decorations 22 may comprise any conventional holiday decorations, the decorations 22 will likely comprise light emitters that are electrically coupled together.

A cover 24, which may opaque or translucent, includes a bottom wall 26 having a top side 28, a bottom side 30, a first lateral edge 32, a second lateral edge 34, a first end edge 36 and a second end edge 38. A first lateral wall 40 is attached to and extends along the first lateral edge 32. A second lateral wall 42 is attached to and extends along said second lateral edge 34. Each of the first 40 and second 42 lateral walls extends upwardly from the top side 28. Each of the first 40 and second 42 lateral walls is orientated perpendicular to the bottom wall 26. The bottom wall 26 may have a plurality of drainage holes 44 extending therethrough to prevent water from building up in the cover 24. The first 40 and second 42 lateral walls extend upwardly from the bottom wall 26 a distance between 2 inches and 6 inches and the bottom wall 26 has a length from the first end edge 36 to the second end edge 38 greater than 30 inches.

A coupling assembly 46 is attached to the roof overhang 12 and releasably couples the cover 24 to the roof overhang 12. The coupling assembly 46 includes a plurality of hooks. The plurality of hooks includes a first set of hooks 48 attached to the first side 18 of the roof overhang 12 and a second set of hooks 50 attached to the second side of the roof overhang 12. The first set of hooks 48 extends through apertures 52 extending through the first lateral wall 40, and the second set of hooks 50 extends through apertures 52 extending through the second lateral wall 42.

In use, the cover 24 is attached to the roof overhang 12 when the decorations 22 are to be hidden from view. This may be done to allow a person to retain the decorations 22 on the roof overhang 12 as opposed to removing them to only replace them at a later date. Also, if the decorations 22 are light emitters that may be used for multiple holidays, the light emitters may be covered between the holidays. Further, the cover 24 will protect the decorations 22 from the elements when they are not being used.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A decoration covering system comprising:

a roof overhang being attached to and extending downwardly from a roof, said roof overhang having a bottom edge, a first side and a second side positioned opposite of said first side;

a plurality of decorations being attached to said bottom edge of said roof overhang, said decorations comprising light emitters being electrically coupled together by a wire, said wire directly abutting said bottom edge of said roof overhang;

a cover including a bottom wall having a top side, a bottom side, a first lateral edge, a second lateral edge, a first end edge, and a second end edge, a first lateral wall being attached to and extending along said first lateral edge, a second lateral wall being attached to and extending along said second lateral edge, each of said first and second lateral walls extending upwardly from said top side, said cover being spaced from said bottom edge to inhibit water from building up between said bottom edge and said cover, said bottom edge being positioned between said first and second lateral walls, said bottom wall being positioned vertically below said bottom edge;

a coupling assembly being attached to said roof overhang and releasably coupling said cover to said roof overhang, wherein said coupling assembly includes a plurality of hooks, said plurality of hooks being attached to said first side of said roof overhang and extending through apertures extending through said first lateral wall, wherein said hooks attached to said first side of said roof overhang defining a first set of hooks, said plurality of hooks further including a second set of hooks being attached to said second side of said roof overhang, said second set of hooks extending through apertures extending through said second lateral wall;

and said cover being removably attached to said roof overhang when said decorations are being hidden from view.

2. The system according to claim 1, wherein each of said first and second lateral walls is orientated perpendicular to said bottom wall.

3. The system according to claim 1, wherein each of said first and second lateral walls extends upwardly from said bottom wall a distance between 2 inches and 6 inches.

4. The system according to claim 3, wherein said bottom wall has a length from said first end edge to said second end edge greater than 30 inches.

5. A decoration covering system comprising:

a roof overhang being attached to and extending downwardly from a roof, said roof overhang having a bottom edge, a first side and a second side positioned opposite of said first side;

a plurality of decorations being attached to said bottom edge of said roof overhang, said decorations comprising light emitters being electrically coupled together by a wire, said wire directly abutting said bottom edge of said roof;

a cover including a bottom wall having a top side, a bottom side, a first lateral edge, a second lateral edge, a first end edge, and a second end edge, a first lateral wall being attached to and extending along said first lateral edge, a second lateral wall being attached to and extending along said second lateral edge, each of said first and second lateral walls extending upwardly from said top side, each of said first and second lateral walls being orientated perpendicular to said bottom wall, each of said first and second lateral walls extending upwardly from said bottom wall a distance between 2 inches and 6 inches, said bottom wall having a length from said first end edge to said second end edge greater than 30 inches, said bottom wall having a plurality of drainage holes extending therethrough, said cover being spaced from said bottom edge to inhibit water from building up between said bottom edge and said cover, said bottom edge being positioned between said first and second lateral walls, said bottom wall being positioned vertically below said bottom edge;

a coupling assembly being attached to said roof overhang and releasably coupling said cover to said roof overhang, said coupling assembly including a plurality of hooks, said plurality of hooks including a first set of hooks being attached to said first side of said roof overhang and a second set of hooks being attached to said second side of said roof overhang, said first set of hooks extending through apertures extending through said first lateral wall, said second set of hooks extending through apertures extending through said second lateral wall; and said cover being removably attached to said roof overhang when said decorations are being hidden from view.

* * * * *